US006214201B1

(12) United States Patent
Park et al.

(10) Patent No.: US 6,214,201 B1
(45) Date of Patent: Apr. 10, 2001

(54) PROCESS FOR MANUFACTURING FUNCTIONAL ACTIVATED CARBON FIBERS TREATED BY ANODIC OXIDATION

(75) Inventors: Soo-Jin Park; Jae-Rock Lee; Ki-Dong Kim; Byung-Jae Park, all of Daejeon (KR)

(73) Assignee: Korean Research Institute of Chemical Technology (KR)

( * ) Notice: Subject to any disclaimer, the term of this patent is extended or adjusted under 35 U.S.C. 154(b) by 0 days.

(21) Appl. No.: 09/231,390

(22) Filed: Jan. 13, 1999

(30) Foreign Application Priority Data

Aug. 8, 1998 (KR) ..... 98-32267

(51) Int. Cl.[7] ..... C25F 1/00
(52) U.S. Cl. ..... 205/687; 205/768
(58) Field of Search ..... 205/657, 768

(56) References Cited

U.S. PATENT DOCUMENTS 4,234,398 * 11/1980 Yamamoto ..... 205/768

5,589,055 * 12/1996 Kobayashi et al. ..... 205/768

* cited by examiner

*Primary Examiner*—Arun S. Phasge
(74) *Attorney, Agent, or Firm*—Pennie & Edmonds LLP

(57) ABSTRACT

The present invention relates to a process for manufacturing activated carbon fibers having greatly improved adsorption performance time and adsorption performance when in contact with surface oxides such as in the case where gas and liquid impurities are treated. The process of the present invention comprises the following steps:

Figure 1:
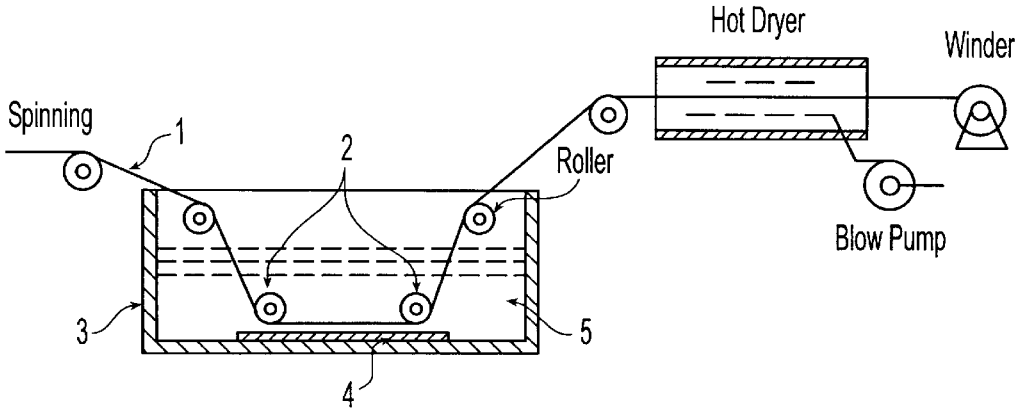

a) placing conventional activated carbon fibers between an anode and a cathode plate in an acidic or an alkaline electrolytic solution, and b) applying a certain voltage at a current density between said graphite anode and graphite cathode plate.

The present invention also relates to the product resulting from this process and the use of this product.

10 Claims, 1 Drawing Sheet

PROCESS FOR MANUFACTURING FUNCTIONAL ACTIVATED CARBON FIBERS TREATED BY ANODIC OXIDATION

TABLE OF CONTENTS

1. BACKGROUND OF THE INVENTION
1.1 Field of the Invention
1.2 Description of the Prior Art
2. SUMMARY OF THE INVENTION
3. BRIEF DESCRIPTION OF THE DRAWINGS
4. DETAILED DESCRIPTION OF THE PREFERRED EMBODIMENTS
4.1 Example 1
4.2 Example 2
4.3 Example 3
4.4 Example 4
4.5 Example 5
4.6 Example 6
4.7 Example 7
4.8 Table 1
4.9 Table 2
5. CLAIMS
6. ABSTRACT
7. DRAWING

1. BACKGROUND OF THE INVENTION

1.1 Field of the Invention

The present invention relates to a process for manufacturing highly functional activated carbon fibers having oxygen functional groups introduced onto the surface thereof by anodic oxidation, the product resulting from this process and the use of this product. More specifically, it relates to a process for manufacturing activated carbon fibers having greatly improved adsorption performance time and adsorption performance when in contact with surface oxides such as in the case where gas and liquid impurities are treated by an anodic oxidation treatment of conventional activated carbon fibers by electrochemical techniques using an acidic and alkaline solution as an electrolyte.

1.2 Description of the Prior Art

As pollution of the environment has become a public concern, the removal of liquid and gas impurities has become a public demand. Under such circumstances, the development of improved adsorbents to meet such demands is urgently needed.

The activated carbon fibers have highly specific surface area and surface reactivity, good adsorptivity and micropores. They have been widely used in waste water and sewage disposal apparatus in houses and industrial facilities, apparatus for removing harmful gases in the facilities for manufacturing semiconductors and precision measuring machines, anti-gas masks for military use and general industrial use and air cleaning apparatus in offices and houses.

The activated carbon fibers have been used for the purpose of purification, collection and separation in many fields. They are organic adsorbents in a saturated binding form and have the well-developed micropores, which are the barometers for evaluating adsorptivity as adsorbents, as compared to inorganic adsorbents of an unsaturated binding form such as silica gel, alumina gel and synthetic zeolite. They also show a good molecular sieve effect, because they have a further broader adsorption surface area and a comparatively regular size of micropore as compared to conventional carbon fibers, the shape of which is restricted to a granular or powder form. In addition, they have good stability, cyclability, and processibility clue to a fiber form, thereby the demand for such carbon fibers gradually increases.

The conventional methods for improving the performance of activated carbon fibers include methods for introducing functional groups onto activated carbon fibers such as:

1) developing micropores and a specific surface area by thermally treating activated carbon fibers at high temperature,
2) forming surface functional groups by dipping activated carbon fibers in an acidic or alkaline solution, or
3) forming functional groups on activated carbon fibers by reacting activated carbon fibers in a gas at high temperature.

However, these methods have several problems. The surface structure and surface properties of the activated carbon fibers may depend on activating temperature and time, however, it is difficult to control time and temperature. Since side reactions may be caused where surface treatment is conducted in a high temperature gas, many apparatus and costs for inhibiting those side reactions are needed. In addition, since the surface functional groups attached to the surface of the activated carbon fibers are not able to continuously display their function, the adsorption performance thereof is unsatisfactory.

2. SUMMARY OF THE INVENTION

The present inventors have undertaken extensive studies in order to overcome the above-mentioned problems inherent in the aforementioned preparation of activated carbon fibers. As a result, the present inventors have now found that functional activated carbon fibers can be obtained by treating the surface of conventional activated carbon fibers through an electrochemical technique. The present invention is attained on the basis of this finding.

It is therefore an objective of the invention to provide a method for manufacturing highly functional activated carbon fibers, characterized by the following features:

a) there is no need to control time and temperature in treating activated carbon fibers, and
b) it is possible to improve and continuously display the adsorptivity without necessitating separate apparatus or processes for avoiding side reactions.

The present invention relates to a process for manufacturing highly functional activated carbon fibers, which comprises placing conventional activated carbon fibers between an anode and a cathode plate in an electrolytic solution, and applying a voltage of about 1V to about 20V at a current density of about 5 $mA/m^2$ to about 450 $mA/m^2$ between the anode and the cathode plate for an effective amount of time. The present invention also relates to the product obtained by this process, and the use of the product so obtained.

In one embodiment the product is used to treat gas and liquid impurities.

The other objectives and features of the present invention will become apparent to those skilled in the art from the following detailed description. It should be understood, however, that the detailed description and specific examples, while indicating preferred embodiments of the present invention are given by way of illustration and not limitation. Many changes and modifications within the scope of the present invention may be made without departing from the spirit thereof, and the invention includes all such modifications.

3. BRIEF DESCRIPTION OF THE DRAWINGS

FIG. 1 shows an apparatus for treating the surface of activated carbon fibers by anodic oxidation according to the present invention.

4. DETAILED DESCRIPTION OF THE PREFERRED EMBODIMENTS

The present invention relates to a process for manufacturing highly functional activated carbon fibers having improved adsorptivity by treating the surface of conventional activated carbon fibers using an electrochemical technique.

When the surface of solid materials is treated with two or more heterologous materials such as adsorption materials and composite materials, the final physical properties of the solid materials treated, generally, depend not on the inherent properties of each material, but on the function at interface between the heterologous materials. For example, in cases where liquid impurities are treated with conventional activated carbon fibers, the activated carbon fibers show a little adsorptivity corresponding to the adsorption performance appearing on the surface of the activated carbon fibers, However, the adsorption performance and adsorption rate of the activated carbon fibers may be greatly improved only by treating the surface of the activated carbon fibers in a simple manner.

Generally, the adsorption process of activated carbon fibers can be divided into three steps:

1) Adsorbate molecules of the activated carbon fibers migrate to the outer surface of adsorbent;
2) The adsorbate molecules diffuse through the macropore and mesopore of the adsorbent;
3) Finally, the diffused adsorbate molecules are adsorbed by binding with the inner surface of the micropore or filling into the rnicropore.

In further detail, the present invention provides a process for manufacturing highly functional activated carbon fibers, which comprises placing conventional activated carbon fibers between an anode and a cathode plate in an acidic or an alkaline eletrolytic solution and applying a current at a voltage of about IV to about 20V and a current density of about 5 $mA/m^2$ to about 450 $mA/m^2$ between the anode and the cathode plate.

In one embodiment the anode is a graphite anode and the cathode plate is a graphite cathode plate.

As an alkaline electrolytic solution usable in the present invention, a Lewis base solution such as NaOH, NaCl and NaClO can be exemplified. As an acidic electrolytic solution usable in the present invention, a Lewis acid solution such as $H_3PO_4$, $H_2SO_4$, $HNO_3$ and HCl can be exemplified.

The concentration of an acidic or an alkaline electrolytic solution is preferably in the range of about 5% to about 40% by weight. If the concentration is less than about 5% by weight, the amount of surface functional groups formed on the surface of the activated carbon fibers is minimal, because the concentration of the electrolyte dissociated by anodic oxidation is low, If the concentration exceeds about 40% by weight, many electrolytes dissociated corrode the surface of the activated carbon fibers to cause changes in surface porosity due to the phenomenon such as etching in the axial direction of fibers.

According to the present invention, the voltage applied to an anode and a cathode is preferably about 1V to about 20V. If the voltage is less than about 1V, the amount of surface functional groups formed on the surface of the activated carbon fibers is very minimal, because the concentration of the electrolytes disassociated by anodic oxidation is low. If the voltage exceeds about 20V, many electrolytes disassociated corrode the surface of the activated carbon fibers and cause changes in surface porosity due to the phenomenon such as etching in the axial direction of fibers.

The current density is preferably in the range of about 5 $mA/m^2$ to about 450 $mA/m^2$. If the current density is less than about 5 $mA/m^2$ the amount of surface functional groups formed on the surface of the activated carbon fibers is very minimal because the concentration of the electrolytes disassociated by anodic oxidation is low. If the current density exceeds about 450 $mA/m^2$, many electrolytes disassociated corrode the surface of the activated carbon fibers and cause changes in surface porosity due to the phenomenon such as etching in the axial direction of fibers.

In the present invention, it is preferable to apply a current for about 10 to about 120 seconds. If the current is applied less than about 10 seconds, the amount of surface functional groups formed on the surface of the activated carbon fibers is very minimal because the concentration of the electrolytes disassociated by anodic oxidation is low. If the current is applied for more than about 120 seconds, many electrolytes disassociated corrode the surface of the activated carbon fibers and cause changes in surface porosity due to the phenomenon such as etching in the axial direction of fibers.

The adsorption rate and performance of the activated carbon fibers obtained through the aforementioned action are known to be dependent on various properties of the activated carbon fibers, for example, micropores, polarity at surface and oxygen compounds at surface. Methods for introducing functional groups onto the surface of activated carbon fibers include an ozone treatment method, a solution treatment method and a method of reacting activated carbon fibers with oxygen in a gas at high temperature.

One aspect of this invention is to prepare highly functional activated carbon fibers having improved adsorption performance which display their function continuously.

As an oxygenic functional group which is introduced to the surface of the activated carbon fibers and is regarded as a cause affecting the surface acidity, carboxylic group, phenol group, lactone group and acid anhydride can be exemplified.

When the surface of conventional activated carbon fibers is treated using an electrochemical technique according to the present invention, several functional groups and geometrical structural properties are given to the treated surface to improve the degree of activation on the surface of the activated carbon fibers or disassociation energy, which in turn improves adsorption performance.

The apparatus for anodic oxidation of activated carbon fibers is shown in FIG. 1. As shown in FIG. 1, activated carbon fibers [1] are fixed at the anode rollers [2] made of graphite. A cathode plate [4] installed in the bottom of an anode electrolytic cell [3] is also made of graphite. Therefore, an electric current runs between those two electrodes to cause electrolysis. The activated carbon fibers [1] thus surface-treated are dried by passing through a hot drier equipped with a blow pump and then are rolled up by a winder.

The present invention is described in more detail by referring to the following examples without limiting the scope of the invention in any way.

4.1 EXAMPLE 1

A phenol-based activated carbon fiber (manufactured by Kuraray Co. in Japan) was used. As an electrolytic solution

[5], about 5% by weight of aqueous NaOH solution was used. The surface of the activated carbon fiber was treated with the electrolytic solution using an electrochemical technique at a voltage of about 2V and a current density of about 45 $mA/m^2$ for about 30 seconds. The amount of adsorption and adsorption rate of the obtained activated carbon fiber are shown in Table 1 and Table 2, respectively. As a result, it was found that BET specific surface area and volume of micropore did not show much change, but the surface acidity increased by 55%. This is because the electrochemical surface treatment did not affect the surface structure and pore structure of the activated carbon fibers. Instead, carbons on the surface of the activated carbon fibers reacted with ions of the electrolytic solution to form new functional groups. As a result, the adsorption amount of hexavalent chrome and the constant of primary adsorption rate increased by 35% and 51%, respectively, as compared to those of the non-surface treated sample.

4.2 EXAMPLE 2

An activated carbon fiber was subjected to an electrochemical surface treatment by using a Lewis base solution, about 7% by weight of NaCl solution, as an electrolytic solution in a similar fashion to Example 1, for about 10 seconds at a voltage of IV and a current density of about 15 $mA/m^2$. The amount of adsorption and adsorption rate of the obtained activated carbon fiber are shown in Table 1 and Table 2, respectively. As a result, it was found that BET specific surface area and volume of micropore did not show much change, but the surface acidity increased by 123%. This is because the electrochemical surface treatment did not affect the surface structure and pore structure of the activated carbon fibers, Instead, carbons on the surface of the activated carbon fibers reacted with ions of the electrolytic solution to form new functional groups. As a result, the adsorption amount of hexavalent chrome and the constant of primary adsorption rate increased by 28% and 44%, respectively, as compared to those of the non-surface treated sample.

4.3 EXAMPLE 3

An activated carbon fiber was subjected to an electrochemical surface treatment by using a Lewis base solution, about 10% by weight of NaClO solution, as an electrolytic solution in a similar fashion to Example 1, for about 60 seconds at a voltage of about 2V and a current density of about 45 $mA/m^2$. The amount of adsorption and adsorption rate of the obtained activated carbon fiber are shown in Table 1 and Table 2, respectively. As a result, it was found that BET specific surface area and volume of micropore did not show much change, but the surface acidity increased by 51%. This is because the electrochemical surface treatment did not affect the surface structure and pore structure of the activated carbon fibers, Instead, carbons on the surface of the activated carbon fibers reacted with ions of the electrolytic solution to form new functional groups. As a result, the adsorption amount of hexavalent chrome and primary adsorption rate constant increased by 32% and 47%, respectively, as compared to those of non-surface treated sample.

4.4 EXAMPLE 4

An activated carbon fiber was subjected to an electrochemical surface treatment by using a Lewis acid solution, about 20% by weight of $H_3PO_4$ solution, as an electrolytic solution in a similar fashion to Example 1, for about 90 seconds at a voltage of IV and a current density of about 5 $mA/m^2$. The amount of adsorption and adsorption rate of the obtained activated carbon fiber are shown in Table 1 and Table 2, respectively. As a result, it was found that BET specific surface area and volume of micropore did not show much change, but the surface acidity increased by 166%. This is because the electrochemical surface treatment did not affect the surface structure and pore structure of the activated carbon fibers. Instead, carbons on the surface of the activated carbon fibers reacted with ions of the electrolytic solution to form new functional groups. As a result, the adsorption amount of hexavalent chrome and the constant of primary adsorption rate increased by 25% and 71%, respectively, as compared to those of the non-surface treated sample. 25

4.5 EXAMPLE 5

An activated carbon fiber was subjected to an electrochemical surface treatment by using a Lewis acid solution, about 35% by weight of $H_2SO_4$ solution, as an electrolytic solution in a similar fashion to Example 1, for about 50 seconds at a voltage of about 6.7V and a current density of about 150 $mA/m^2$. The amount of adsorption and adsorption rate of the obtained activated carbon fiber are shown in Table 1 and Table 2, respectively. As a result, it was found that BET specific surface area and volume of micropore did not show much change, but the surface acidity increased by 123%. This is because the electrochemical surface treatment did not affect the surface structure and pore structure of the activated carbon fibers. Instead, carbons on the surface of the activated carbon fibers reacted with inns of the electrolytic solution to form new functional groups. As a result, the adsorption amount of hexavalent chrome and the constant of primary adsorption rate increased by 39% and 52%, respectively, as compared to those of the non- surface treated sample.

4.6 EXAMPLE 6

An activated carbon fiber was subjected to an electrochemical surface treatment by using a Lewis acid solution, about 40% by weight of $HNO_3$ solution, as an electrolytic solution in a similar fashion to Example 1, for about 120 seconds at a voltage of about 20V and a current density of about 450 $mA/m^2$. The amount of adsorption and adsorption rate of the obtained activated carbon fiber are shown in Table 1 and Table 2, respectively. As a result, it was found that BET specific surface area and volume of micropore did not show much change, but the surface acidity increased by 141%. This is because the electrochemical surface treatment did not affect the surface structure and pore structure of the activated carbon fibers. Instead, carbons on the surface of the activated carbon fibers reacted with ions of the electrolytic solution to form new functional groups. As a result, the adsorption amount of hexavalent chrome and the constant of primary adsorption rate increased by 44% and 43%, respectively, as compared to those of the non-surface treated sample.

4.7 EXAMPLE 7

An activated carbon fiber was subjected to an electrochemical surface treatment by using a Lewis acid solution, about 40% by weight of HCl solution, as an electrolytic solution in a similar fashion to Example 1, for about 120 seconds at a voltage of about 20V and a current density of about 450 $mA/m^2$. The amount of adsorption and adsorption rate of the obtained activated carbon fiber are shown in Table 1 and Table 2, respectively. As a result, it was found that BET specific sm-face area and volume of mic:ropore did not show much change, but the surface acidity increased by 215%. This is because the electrochemical surface treatment did not affect the surface structure and pore structure of the activated carbon fibers. Instead, carbons on the surface of the activated carbon fibers reacted with ions of the electrolytic solution to form new functional groups. As a result, the adsorption amount of hexavalent chrome and the constant of primary adsorption rate increased by 50% and 80%, respectively, as compared to those of the non-surface treated sample.

The activated carbon fibers treated by anodic oxidation were used after being dried at 100° C. for about six hours. The specific surface area, surface acidity, hexavalent chrome adsorability from aqueous solution of the activated carbon fibers obtained in the above examples over conventional activated carbon fibers were determined by the following method and the results were collectively listed in Table 1.

BET Specific Surface Area

Under liquid nitrogen atmosphere at −196° C., about 0.2 g of sample was taken. Nitrogen gas was used as an adsorbate. The adsorption amount in accordance with the increment of concentration of nitrogen gas was determined. When $P/P_0$ (P is a partial pressure and $P_0$ is a saturated steam pressure) is in the range of about 0.05 to 0.3, $P/P_0$ showed a linear gradient with an adsorption amount, from which BET specific surface area and volume of micropore were calculated.

Surface Acidity

The surface acidity of activated carbon fibers was determined by a selective neutralization method of Boehm. 1 g of a sample was added to 100 ml of 0.1 N sodium chloride solution. After sealing, the resultant solution was stirred at room temperature for 48 hours and filtered. 20 ml of supernatant was taken and titrated with 0.1N hydrochloric acid solution. As an indicator, phenolphthalein was used.

Hexavalent Chrome Adsorptivity $Na_2CrO_4$ $4H_2O$ was added to secondary distilled water. While nitrogen was introduced, the resultant mixture was stirred at room temperature to give a chrome solution. The concentration of the chrome solution was controlled to 26 ppm and 50 ppm in a chrome ratio. Since the adsorption amount of hexavalent chrome largely depends on the pH of the chrome solution, the pH of the chrome solution was fixed to pH 3.0 by using 0.1N chrome solution and 0.1N sodium hydroxide solution. When diplienylcarbazide solution, as a coupler, was added to the chrome solution, a hexavalent chrome compound was formed in pink color. Adsorbance at a wavelength of 540 rim was determined by using an ultraviolet spectrophotometer. The concentration of hexavalent chrome was calculated from a calibration graph prepared in advance. The evaluation of an adsorption rate of hexavalent chrome was conducted as follows. First, 150 ml of a solution consisting of 500±1 mg of a sample and 26 ppm of chrome was added to a beaker and the concentration of chrome was determined with the passing of time while stirring with a shake. The equilibrium adsorption amount of hexavalent chrome in the solution was calculated as follows. To a 100 ml aqueous chrome solution containing 50 ppm of chrome, 200±1 mg of a sample was added. After stirring 24 hours in a shaker, the supernatant formed was taken and the concentration of chrome was determined in a similar fashion as in the above-mentioned procedure.

TABLE 1

| | BET specific surface [m2/g] | Volume of microphore [cc/g] | Surface acidity [meq/g] |
|---|---|---|---|
| Untreated activated Carbon fiber | 1646 | 0.76 | 325 |
| Example 1 | 1642 | 0.75 | 505 |
| Example 2 | 1640 | 0.73 | 723 |
| Example 3 | 1642 | 0.75 | 490 |
| Example 4 | 1645 | 0.75 | 865 |
| Example 5 | 1649 | 0.76 | 726 |
| Example 6 | 1644 | 0.75 | 783 |
| Example 7 | 1640 | 0.72 | 1023 |

*Each calculated value is expressed as an average value according to the examples.

TABLE 2

| | Adsorption amount of hexavalent chrome [μmol/g] | Primary adsorption rate constant [$10^{-3}$ $min^{-1}$] |
|---|---|---|
| Untreated activated Carbon fiber | 293 | 103.8 |
| Example 1 | 394 | 157.0 |
| Example 2 | 375 | 148.9 |
| Example 3 | 387 | 152.1 |
| Example 4 | 366 | 177.6 |
| Example 5 | 408 | 157.2 |
| Example 6 | 423 | 148.2 |
| Example 7 | 440 | 186.3 |

*Each calculated value is expressed as an average value according to the examples.

Effects of the Invention

As clearly seen from Tables 1 and 2, the activated carbon fibers prepared by the present invention (Examples 1 to 7) showed little difference in BET specific surface area and volume of microphore as compared to conventional non-treated activated carbon fibers. However they showed surface acidity higher by about 1.5 to 3 times, a hexavalent chrome adsorption amount higher by about 1.2 to 2.8 times, and the constant of primary adsorption rate higher by about 1.4 to 1.8 times, as compared to those of conventional non-treated activated carbon fibers.

As aforementioned, those activated carbon fibers treated by an electrochemical method in accordance with the present invention greatly improve adsorption performance and adsorption rate without changing the structure of the surface and pore. In addition, the functional groups formed on the surface of the activated carbon fibers can continuously exhibit their function.

Furthermore, the present invention can selectively control the surface functional groups according to the adsorbates having a reverse property by changing the electrolytic solution to an acidic or an alkaline. In prior art, an additional apparatus for inhibiting side reactions was needed, because the surface treatment was conducted at high temperature. However, the present invention does not require such an apparatus and thus proceeds continuously. Therefore, the present invention can be easily conducted and economical.

What is claimed is:

1. A process for manufacturing highly functional activated carbon fibers, which comprises placing conventional activated carbon fibers between an anode and a cathode plate in an electrolytic solution, and applying a voltage of about 1V to about 20V at a current density of about 5 $mA/m^2$ to about 450 $mA/m^2$ between said anode and said cathode plate for an effective amount of time.

2. The process of claim 1 wherein the anode is a graphite anode and the cathode plate is a graphite cathode plate.

3. The process of claim 1 wherein the electrolytic solution is acidic.

4.The process of claim 3 wherein the acidic electrolytic solution is a Lewis acid solution.

5. The process of claim 4 wherein the Lewis acid solution is $H_3PO_4$, $H_2SO_4$, $HNO_3$ or HCl.

6. The process of claim 1 wherein the electrolytic solution is alkaline.

7. The process of claim 6 wherein the alkaline electrolytic solution is a Lewis base solution.

8. The process of claim 7 wherein the Lewis base solution is NaOH, NaCl o or NaClO.

9. The process of claim 1 wherein the concentration of the electrolytic solution is about 5% to about 40% by weight.

10. The process of claim 1 wherein the voltage is applied for about 10 seconds to about 120 seconds.

* * * * *